United States Patent [19]

Wilkie

[11] Patent Number: 4,976,642

[45] Date of Patent: Dec. 11, 1990

[54] LIFE RING

[76] Inventor: Lawrence A. Wilkie, 292 Ponderosa Drive, Lake Echo, Halifax County, Halifax County, Nova Scotia, Canada, B0J 2S0

[21] Appl. No.: 407,646

[22] Filed: Sep. 15, 1989

[51] Int. Cl.[5] ..... B63C 9/08

[52] U.S. Cl. ..... 441/131; 441/81

[58] Field of Search ..... 441/81, 83, 84, 106, 441/108, 113, 131; 182/3, 142

[56] References Cited

U.S. PATENT DOCUMENTS

| | | | |
|---|---|---|---|
| 715,261 | 12/1902 | Hamilton | 441/131 |
| 1,368,529 | 2/1921 | Williams | 441/102 |
| 1,625,971 | 4/1927 | Adams | 441/ |
| 1,838,086 | 12/1931 | Farnstrom | 441/131 |
| 2,001,384 | 5/1935 | Garvey | 441/131 |
| 2,800,666 | 7/1957 | Allenbach | 441/131 |
| 3,099,845 | 8/1963 | Chamberlain | 441/80 |
| 3,742,538 | 7/1973 | Smith | 441/81 |
| 4,059,859 | 11/1977 | Hull | 441/81 |
| 4,261,070 | 4/1981 | Shimokawa | 441/81 |
| 4,523,913 | 6/1985 | Kaino | 441/81 |
| 4,540,372 | 9/1985 | Mauck | 441/81 |
| 4,549,871 | 10/1985 | Verney | 441/81 |
| 4,599,073 | 7/1986 | Fryer et al. | 441/108 |

FOREIGN PATENT DOCUMENTS

| | | | |
|---|---|---|---|
| 149417 | 6/1913 | Canada . | |
| 169705 | 5/1916 | Canada . | |
| 1194731 | 10/1985 | Canada . | |
| 84688 | 12/1954 | Norway | 441/81 |
| 8400733 | 3/1984 | World Int. Prop. O. | 441/81 |

*Primary Examiner*—Sherman Basinger
*Assistant Examiner*—Edwin L. Swinehart
*Attorney, Agent, or Firm*—Venable, Baetjer, Howard & Civiletti

[57] ABSTRACT

A life ring is disclosed which is adapted to fit generally about the waist of a person and to secure their arms so as to prevent them from accidentally slipping out of the ring as they are pulled from the water. The life ring comprises a generally rigid inner ring with a flexible outer ring located externally around the same. The outer ring is adaptably secured to the inner ring and the two rings are disposed a spaced distance apart. The iner ring has an approximately circular outer circumference and an approximately circular central aperture extending therethrough. The outer ring includes a mechanism for varying the circumference of the same. The outer ring is also adapted to attach to a towing or hoisting rope. The person enters the aperture within the inner ring and positions their arms in the space between the inner and outer rings. As tension is applied to the towing rope, the circumference of the outer ring is varied, and the outer and inner rings engage about the arms of the person thereby securing the person within the life ring.

14 Claims, 4 Drawing Sheets

LIFE RING

BACKGROUND OF THE INVENTION

This invention relates generally to life rings and more specifically to life rings comprising two concentric rings which are adapted to hold a person more securely during their removal from the water.

SUMMARY OF THE PRIOR ART

Life rings are commonly used to assist in preventing potential drowning victims from drowning and to help pull them from the water. In cold water especially, hypothermia can quickly render the potential victim totally helpless so that they are so weak that they cannot grip onto a life ring or maintain their hold as it is pulled from the water. The victim may also become unconscious and/or slip out of the life ring long before rescuers are able to pull them from the water.

Various solutions to this problem have been proposed by the prior art.

Canadian patent No. 1,194,731 to Mauck relates to a life preserver having a specialized adapter cover which covers and is secured to a series of straps 28 which are attached to the cover and hold rope means 34 substantially against the inner periphery of the annular ring. (See FIG. 1). The yieldable nature of the straps 28 permits the rope means 34 to be pulled radially inwardly during use of the device. (See FIG. 3). In the Mauck device, the outer ring is rigid and the rope is constricted about the torso of the wearer when tension is applied to the tow line, thereby assisting in retaining the wearer in the life preserver.

U.S. Pat. No. 3,742,538 to Smith discloses a strapless life preserver which is reversible and is worn so as to allow for free use of the arms of the wearer. The preserver is preferably formed from a singular helical tubular structure of air-tight, semi-resilient material arranged in a manner to provide two annular tubular wings of generally similar size and shape. The ends of the tubular structure are fastened together at a central point so that the two wings are biased together thus making the preserver self-clamping against the torso of the wearer.

U.S Pat. No. 2,001,384 to Garvey discloses a flexible life belt wherein three inflatable elongated tubes 16, 26 and 27 are provided, each of somewhat greater length so as to enable the rings to be concentrically arranged when inflated as shown in FIGS. 1 and 2. The belt has shoulder straps to secure the wearer to the life belt.

SUMMARY OF THE INVENTION

The present invention is a life ring which is adapted to fit generally about the waist and to secure the arms of the person so that they are held more securely within the life ring. The life ring comprises a generally rigid inner ring, formed of a floatation material, with a flexible outer ring located externally of the same. The inner ring has a continuous, approximately circular outer circumference and has an approximately circular central aperture extending therethrough. The outer ring is adaptably secured to the inner ring by a suitable means. The victim enters the aperture in the inner ring and then places his/her arms in the space between the inner and outer rings The outer ring includes a means for varying the circumference of the outer ring to facilitate engagement of the outer and inner rings about the arms of the victim so that the victim is held more securely within the life ring.

In the preferred embodiment of the invention, the means for securing the outer ring to the inner ring comprises a rigid pin member and resilient and flexible first and second spring members. Each of the first and second spring members are secured to both the inner ring and the outer ring at positions generally equidistant from the rigid pin member and from each other The life ring of the preferred embodiment ma also include a telescoping sleeve member which is located within the outer ring generally between the first and second spring members and diametrically opposite the rigid pin member. The resiliently flexible spring members function in association with the telescoping sleeve member to provide a means for varying the distance between the outer and inner rings.

The preferred embodiment of the present invention may also include a channel means running substantially about the external peripheral edge of the outer ring, and a rope means received within said channel. The rope means is adapted for attachment to a towing or hoisting rope and when tension is applied to the towing or hoisting rope, the rope means in the channel in the outer ring acts causes the circumference of the outer ring to vary, thereby facilitating the engagement of the outer and inner rings about the arms of the victim.

BRIEF DESCRIPTION OF THE DRAWINGS

The preferred embodiment of the present invention will now be more fully described with the aid of the following drawings, in which.

DETAILED DESCRIPTION OF THE DRAWINGS

Figure 1:
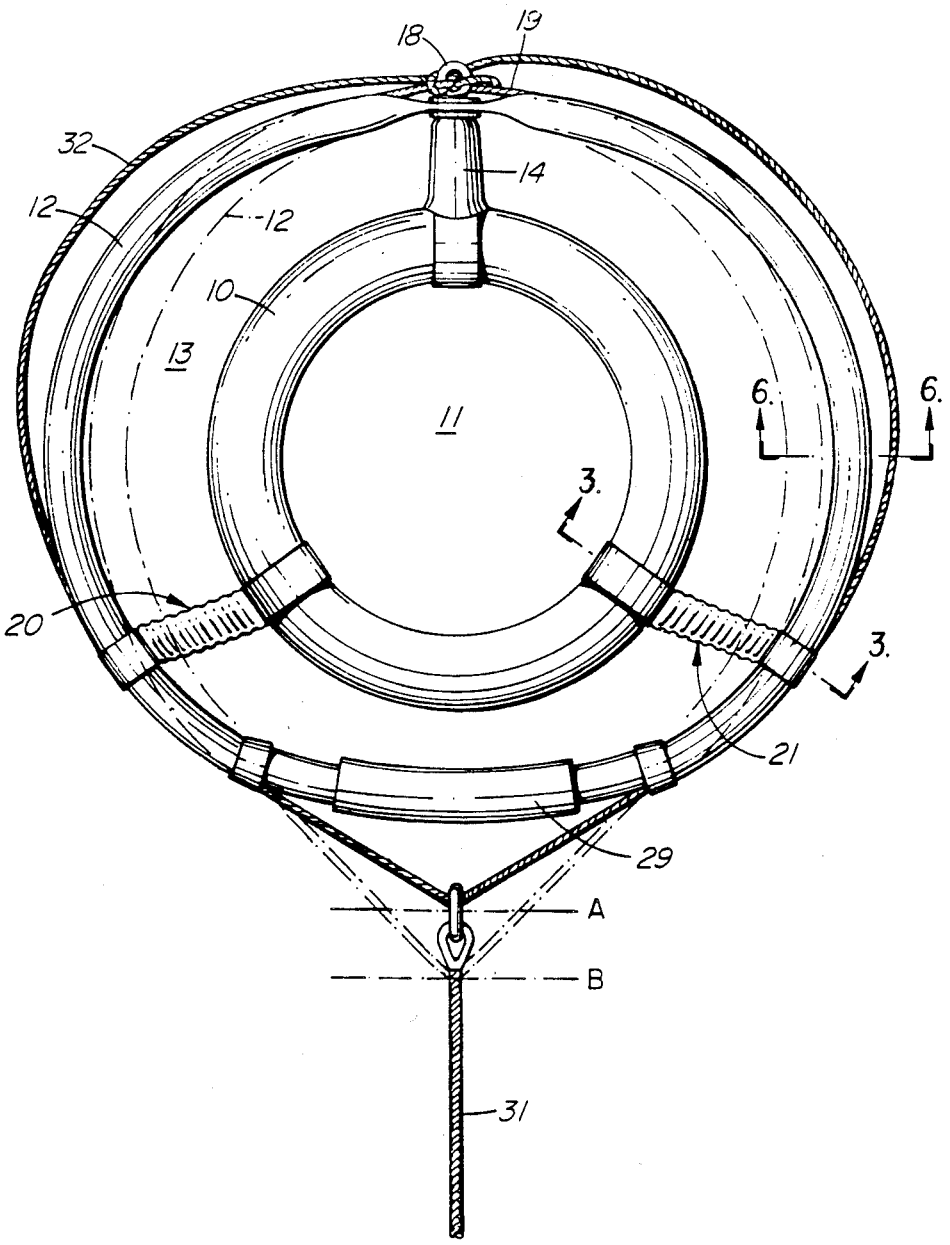
FIG. 1 is a plan view of the life ring of the present invention.

Referring to FIG. 1 there is shown a life ring adapted to fit generally about the waist and also to secure the arms of the victim. The life ring comprises a generally rigid inner ring 10, having a continuous, approximately circular outer circumference and having an approximately circular central aperture 11 extending therethrough. The victim's body (not shown) is received in the aperture 11. A flexible outer ring 12 is located externally of the inner ring 10 and is adaptably secured thereto. The outer ring 12 includes a means for varying the circumference of the outer ring 12 to facilitate engagement of the outer and inner rings about the arms of the victim which are positioned in the space 13 between the outer and inner rings. When the life ring is lifted out of the water, the victim's arms are secured between the outer and inner rings and this prevents the victim from slipping out of the aperture 11 and back into the water.

The inner ring 10 is formed of a floatation material such as a low density, lightweight, buoyant plastic foam material. Both the inner and outer rings may be manufacturerd from a self-skinning rigid foam or semi-rigid foam, or the outer skin of the rings may be blow-moulded or rotationally moulded from an elastomeric plastic such a polyolefin or soft polyvinylchloride and filled with a flexible foam. The inner ring 10, however, is manufactured so that it is relatively rigid, while the outer ring 12 is manufactured to be relatively flexible. Both rings may be manufactured without the foam and be inflatable-type rings which are inflated with either a gas, or a suitable gas and foam. In the latter instance, the ring should incorporate a means to allow the surplus gas to exit ahead of the foam. Both the inner and outer rings may be either circular or ovoid in shape.

Figure 2:
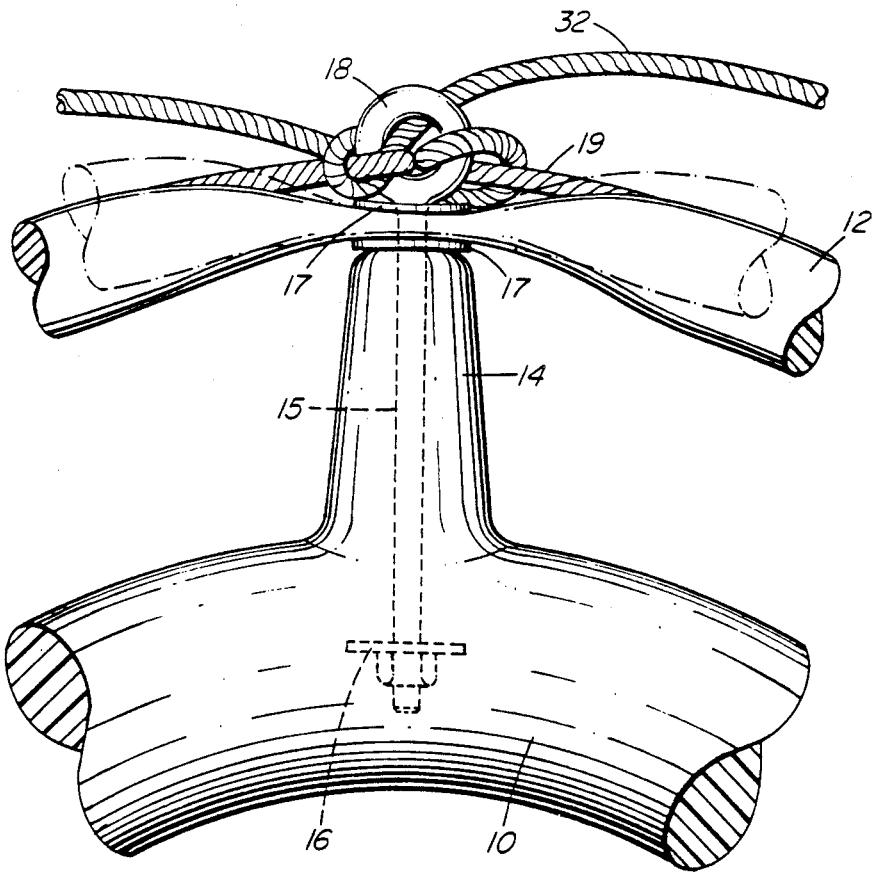
FIG. 2 is a plan view showing in greater detail the connection between the inner and outer rings by way of the pin member.

As is more clearly shown in FIG. 2, the inner ring 10 is formed with a projection 14 which extends from its outer circumference. When the outer ring 12 is disposed externally of the inner ring 10, the projection 14 extends towards the outer ring. A rigid pin member 15 secures the outer ring to the projection 14 of the inner ring 10. A plate nut 16 is embedded in the foam core of the inner ring and the pin member 15 is secured to this plate nut 16. Two washers 17 are utilized, one between the eye 18 of the pin member 15 and the outer ring 12, and one between the outer ring 12 and the projection 14. A rope 19 is slidably secured to the eye 18 and this assists in keeping the pin member 15 securely in the plate nut 16. The rigid pin member 15 maintains the inner and outer rings a certain distance apart from each other.

Figure 3:
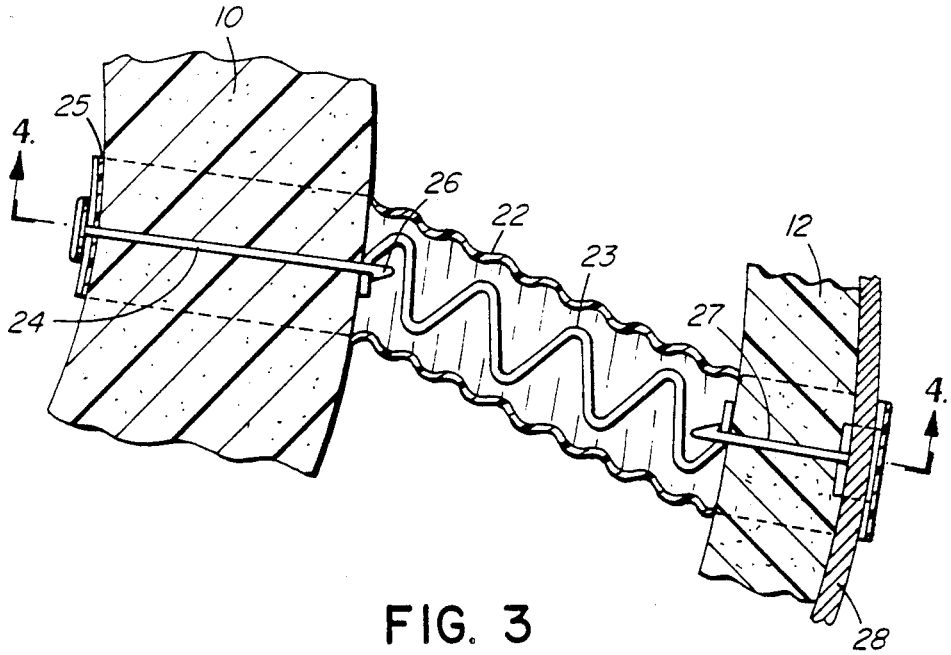
FIG. 3 is a cross-section through line C—C' of FIG. 1.
Figure 4:
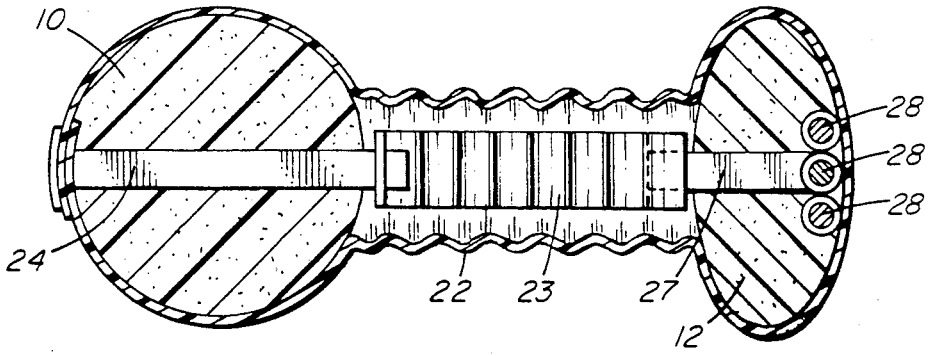
FIG. 4 is a cross-section through line D—D' of FIG. 3.

The inner and outer rings are also connected together by way of two resilient and flexible first and second spring members 20,21. The first and second spring members 20,21 are essentially identical in construction. The spring members are secured to both the inner ring and outer ring at positions generally equidistant from the pin member 15 and from each other. Referring to FIGS. 3 and 4, the structure of either the first or second spring member is shown. Bellows 22, which are moulded from a flexible elastomeric plastic such as polyvinylchloride, house a zig-zag spring 23. During assembly, a push pin 24 engages overlapping ends (not shown) of the bellows collar 25, and is pushed through the foam core of the inner ring 10. The barb 26 at the end of the push pin 24 engages one end of the spring 23, thereby preventing extraction of the push pin 24. Similarly, a sleeve pin 27 is pushed through the foam core of the outer ring 12 and engages the other end of the spring 23. The sleeve pin 27 is provided with two or three sleeves 28 for the rope 19.

Figure 5:
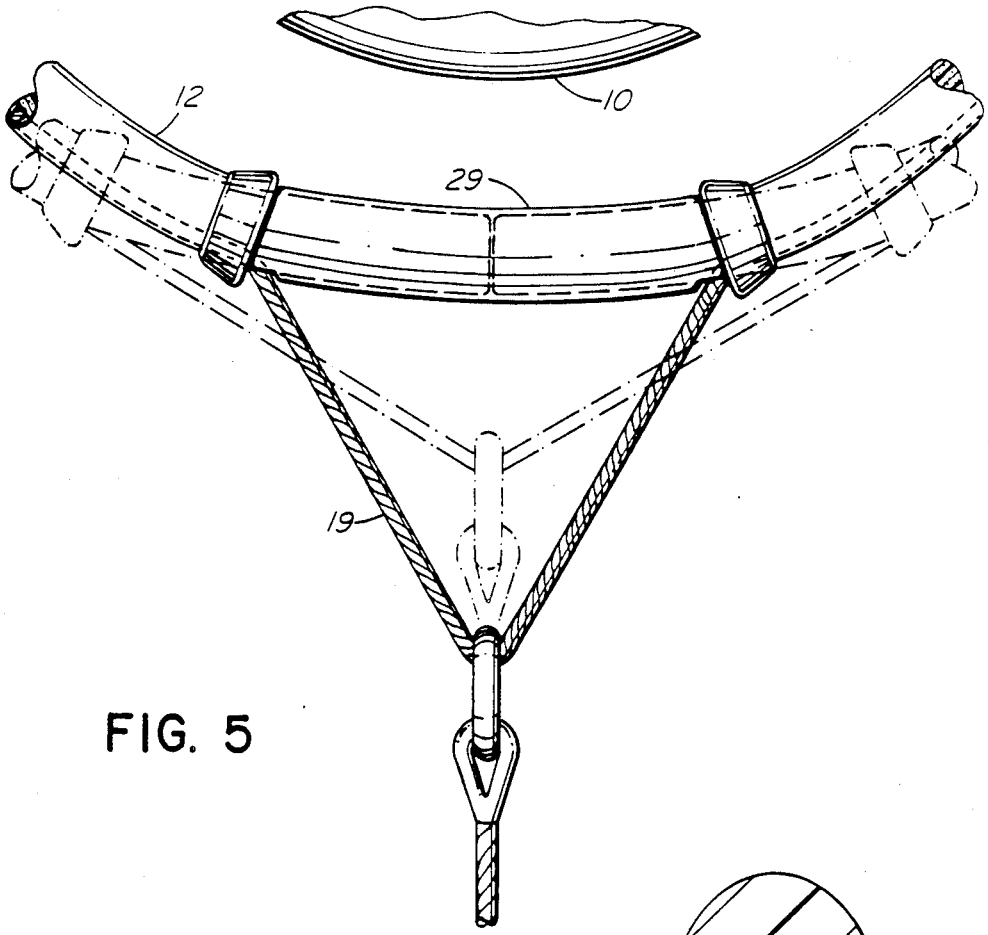
FIG. 5 is a plan view showing in greater detail the telescoping sleeve member and the rope connections for the life ring.

The outer ring 12 is provided with a telescoping sleeve member 29 (FIG. 1 and FIG. 5) which is located within the outer ring, generally between the first and second spring members 20,21, and diametrically opposite the pin member 15. The first and second spring members 20,21 are resiliently flexible to provide a means for varying the distance between the outer and inner ring when functioning in association with the telescoping sleeve member 29.

Figure 6:
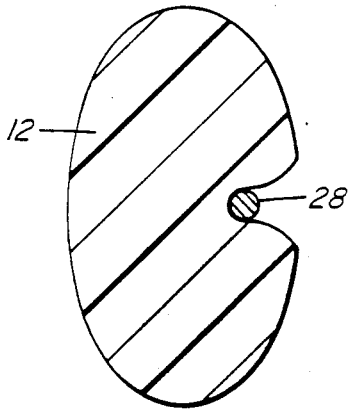
FIG. 6 is a cross-section through line E—E' of FIG. 1.

As can be seen from FIG. 6, the external peripheral edge of the outer ring 12 is provided with a channel 30. The rope 19 is received within this channel 30, encircles the outer ring 12 and is adapted for attachment to a towing or hoisting rope 31. The rope 19 is slidably secured through the eye 18 of the pin member 15, which allows the rope 19 to move circumferentially about the outer peripheral edge of the outer ring. The rigid pin member generally restricts any movement of the rope in a vertical direction.

A grab rope 32 may also be secured to the eye 18 of the pin member 15, passed through a sleeve 28 in each sleeve pin 27 and then tied off with a knot or the like. The grab rope 32 may be provided to assist a victim in catching hold of the life ring.

The inner ring 10 or outer ring 12 may also be provided with one or more compartments (not shown) for housing emergency equipment such as reflective or lighting devices. The inner ring may also be provided with a homing device.

The life ring of the present invention is used in the following manner. The victim enters the aperture 11 in the inner ring 10 and positions their arms in the space 13 between the inner ring 10 and the outer ring 12. Any tension applied to the rope 19 at this point will cause the circumference of the outer ring 12 to be varied and the victim's arms will be engaged between the inner and outer rings. As is shown in FIG. 1, as the tow rope 31 is pulled, it moves the rope 19 from position A to position B. This causes the telescoping sleeve member 29 to be reduced in length, which in turn causes the outer ring 12 to be moved from the position shown in solid lines in FIG. 1 to the position shown in dotted lines on the same figure. This variation in the circumference of the outer ring 12 causes the space 13 to be narrowed, and the victim's arms are engaged between the inner and outer rings.

When it is desired to free the victim, the tension on the tow rope 31 is released. This causes the rope 19 to return to its original position, allowing the telescoping sleeve member 29 to expand, and the outer ring circumference to return to its original shape. The space 13 then returns to its original width, thereby releasing the victim's arms. The victim may then be removed from the aperture 11 in the inner ring 10.

In a preferred embodiment of the present invention the rigid inner ring 10 which is generally filled with lightweight plastic foam or the like may also include compartments to house emergency equipment such as tethering lines, flares, beacon lights and the like.

As will be obvious to those skilled in the art, many variations to the present invention are possible, but all obvious variations are contemplated to fall within the scope of the present invention.

The embodiments of the invention in which an exclusive property or privilege is claimed are defined as follows:

1. A life ring adapted to fit generally about the waist and also to secure the arms of the victim comprising:

a generally rigid inner ring formed of a floatation material, having a continuous approximately circular outer circumference and having a circular central aperture extending therethrough;

a flexible outer ring located externally of the inner ring said flexible outer ring including means for varying the circumference of outer ring to facilitate engagement of the outer and inner rings about the arms of the victim; and means for adaptably securing the outer ring to said inner ring.

2. The life ring of claim 1, wherein the means for securing the outer ring to the inner ring comprising a rigid pin member and first and second resilient flexible spring members, said first and second resilient flexible spring members each being secured to both the inner ring and outer ring at positions generally equidistant from said rigid pin member and from each other.

3. The life ring of claim 2, wherein said means for varying the circumference of the outer ring includes a telescoping sleeve member which is located within the outer ring generally between said spring members and diametrically opposite said rigid pin member.

4. The life ring of claim 3 which includes rope means encircling the outer periphery of said circular flexible outer ring and being adapted for attachment to a towing or hoisting rope.

5. The life ring of claim 4 wherein said flexible outer ring has channel means running substantially about the external peripheral edge of said flexible outer ring, said channel means for receiving said rope means therein.

6. The life ring of claim 4 wherein said rigid pin member is adapted to slidably secure said rope means so as to allow movement of said rope means circumferentially about the outer peripheral edge of said flexible outer ring while generally restricting movement in a vertical direction.

7. The life ring of claim 1 wherein said generally rigid inner ring and flexible outer ring ar circular.

8. The life ring of claim 1 wherein said generally rigid inner ring and flexible outer ring have cross sections which are ovoid.

9. The life ring of claim 1 wherein said flexible outer ring is comprised of elastomeric material.

10. The life ring of claim 1 wherein said flexible outer ring is filled with foam.

11. The life ring of claim 2 wherein said rigid pin member provides spacing means between said generally rigid inner ring and said flexible outer ring.

12. The life ring of claim 4 wherein, in use, said rigid pin member provides fixed spacing means between said generally rigid inner ring and said flexible outer ring, and said first and second spring members being resiliently flexible to provide means for varying the distance between said outer and inner ring when functioning in association with the telescoping sleeve member.

13. The life ring of claim wherein said flotation material consists of a low density, lightweight, buoyant plastic foam material.

14. The life ring of claim 9 wherein said flexible outer ring is filled with foam.

* * * * *